US010690427B1

(12) United States Patent
August

(10) Patent No.: US 10,690,427 B1
(45) Date of Patent: Jun. 23, 2020

(54) ANTI-SPRING FATIGUE FIREARM MAGAZINE

(71) Applicant: Robert August, Midland, NC (US)

(72) Inventor: Robert August, Midland, NC (US)

( * ) Notice: Subject to any disclaimer, the term of this patent is extended or adjusted under 35 U.S.C. 154(b) by 0 days.

(21) Appl. No.: 16/706,252

(22) Filed: Dec. 6, 2019

Related U.S. Application Data

(63) Continuation of application No. 16/385,219, filed on Apr. 16, 2019, now Pat. No. 10,527,374.

(51) Int. Cl.
*F41A 9/67* (2006.01)
*F41A 9/66* (2006.01)

(52) U.S. Cl.
CPC . *F41A 9/67* (2013.01); *F41A 9/66* (2013.01)

(58) Field of Classification Search
None
See application file for complete search history.

(56) References Cited

U.S. PATENT DOCUMENTS

| | | | | |
|---|---|---|---|---|
| 10,527,374 | B1 * | 1/2020 | August | F41A 9/66 |
| 2018/0031342 | A1 * | 2/2018 | Faifer | F41A 9/71 |
| 2018/0347929 | A1 * | 12/2018 | Hsu | F41A 9/72 |

FOREIGN PATENT DOCUMENTS

DE 747658 * 10/1944

* cited by examiner

*Primary Examiner* — Stephen Johnson

(57) ABSTRACT

An anti-spring fatigue firearm magazine incorporates a lower magazine sleeve that can be positioned into an extended configuration relative to the main magazine body in order to reduce or eliminate spring fatigue from extended storage while fully loaded with ammunition.

18 Claims, 8 Drawing Sheets

ANTI-SPRING FATIGUE FIREARM MAGAZINE

The current application is a continuation-in-part (CIP) application of the U.S. non-provisional application Ser. No. 16/385,219 filed on Apr. 16, 2019 (issued on Jan. 7, 2020 as U.S. Pat. No. 10,527,374B1).

FIELD OF THE INVENTION

The present invention relates generally to firearm magazines. More particularly, the present invention relates to mitigating spring fatigue in fully loaded firearm magazines due to extended storage.

BACKGROUND OF THE INVENTION

Firearm magazines, which function to store ammunition and provide it to the firearm's firing chamber, typically utilize a spring to store the energy necessary to move the stored cartridges into the firing chamber. When a metal spring remains compressed for an extended period, the spring metallurgically forms a "set", or a loss of expansion/compression power due to inactivity while maintained in this state. Firearm magazines are often stored with a full load of ammunition to be able to be used as quickly as possible if need be, but in many instances, expenditure of the stored ammunition is not required or planned for, with the result that the loaded magazines remain unused for extended periods of time. This may lead to undesirable malfunction of the firearm should the occasion arise to use the stored magazines.

The primary feature of the present invention is its ability to relax the compression of the magazine spring when the magazine is fully loaded, so that the magazine does not suffer from the undesirable condition of spring fatigue during periods of storage/inactivity. Spring fatigue occurs when the magazine is fully loaded with cartridges and the magazine spring is fully compressed, and remains as such for extended periods of time. This invention allows the user to relax the magazine spring approximately 50% of full compression in order to alleviate the condition of spring fatigue, until it is required to employ the magazine for its intended purpose. This will exponentially extend the life and efficiency of the magazine spring, and hence, the magazine itself. Furthermore, the user can experience greater confidence in their equipment, knowing that it will perform proficiently and capably when needed, even after long periods of storage or inactivity while the magazine is fully loaded.

Another feature of the present disclosure is its ability to instantaneously compress the magazine spring to full compression when required to employ the magazine. In its "closed" position, the magazine functions and performs exactly the same as a standard, non-telescoping magazine. The Anti-Spring Fatigue (ASF) Magazine of the present invention, by design, is only minimally longer and wider than a standard magazine when closed, and so is not cumbersome, awkward or unwieldy for a person to use. It is doubtful that the operator could ascertain whether an ASF Magazine or a standard magazine is inserted in the firearm.

Another feature of the present disclosure is its ability to be easily and cheaply manufactured. The "main body" of the ASF Magazine is a standard, 30-round magazine already in production by numerous manufacturers, though it may be readily adapted for use with any applicable magazine or firearm. Previous attempts of designing and manufacturing a telescoping magazine often involved complete redesign of an already efficient, time-proven mechanism. This invention does not tamper with the dynamics and efficiency of a magazine which has been in practical use for decades. Appropriate feeding of the cartridges through the magazine is completely unchanged. With the exception of the added external "latch ledges" and "stop studs", and removal of the floorplate tabs, there are no modifications to the magazine itself nor are there any alterations, distortions or corruptions which would adversely affect its proper functioning. This magazine simply allows the floorplate to extend while relaxing and enclosing the magazine spring in a movable sleeve. The movable "skirt" or "sleeve" along with simple latch hardware and the full-sized spring necessary to prevent "snaking" are the only true modifications to existing, in-use magazines available today.

Another feature of the present disclosure is its ability to be manufactured using any modern materials such as plastic, polymer, aluminum, carbon fiber, steel, etc. Due to the simplicity of design and function, it is not limited by a required construction medium. As stated, the movable "skirt" or "sleeve" merely encloses the spring and is not subjected to excessive heat or abrasion incurred during the cycle of operation of the firearm to which it is attached.

Another feature of the present disclosure is its ability to easily load or unload the magazine due to reduced spring tension in its "open" or "extended" position. Persons of limited hand strength can load/unload the magazine with a far greater ease because the magazine spring tension is alleviated to an approximate 50% reduction, as opposed to the spring tension of an ordinary magazine.

Another feature of the present disclosure is its ability to combat the undesirable occurrence of "follower tilt". This occurs because the Original Equipment Manufacturer (OEM) spring in a conventional magazine does not completely fill the internal cavity of the magazine, but only about ⅔ of it. Hence, the magazine follower does not rest squarely or completely on the magazine spring. As a result, the magazine follower and cartridges have a tendency of tilting within the confines of the magazine. However, the custom-designed spring for the ASF Magazine has been designed to mirror the profile of the follower itself, and completely fills the internal cavity of the magazine. Both weight and spring tension are more evenly and completely distributed across the bottom of the magazine follower, discouraging the follower's propensity to tilt. Different magazine follower manufacturers may have to slightly modify the dimensional aspects of the magazine spring in order to accommodate different styles and materials of various magazine followers produced today; however, the principles of function and operation will remain consistent.

Another feature of the present disclosure is its ability to be user-friendly to both right- and left-handed persons. The ASF Magazine has been designed using "pawl-lever latches" which, when engaged, holds the magazine sleeve in its "closed" position; and disengages to allow the magazine to be extended to its "open" position. These are located in the front and rear of the movable magazine "sleeve". This ambidextrous feature allows the operator to extend the magazine sleeve with his/her strong or weak hand, even while the magazine is inserted in the firearm, if so desired. Depressing the latches of the ASF Magazine requires approximately eight pounds of pressure, by design. It is worth noting that the vast majority of double-action firearms require approximately 10-12 pounds of pressure to actuate the trigger in order to discharge the firearm. Therefore, if a person is strong enough to press a trigger, that same person can easily actuate the latches on the ASF Magazine.

Another feature of the present disclosure is its ability to provide a more cost effective solution to magazine replacement due to the weakening of a magazine spring. Because of existing military contracts with magazine manufacturers, replacement parts are not provided for, nor are even considered. When the magazine spring weakens to the degree of unserviceability, the entire magazine is replaced. Bearing in mind that the spring is the only part of the magazine which will ever wear out under normal conditions, this design will extend the magazine spring's life almost indefinitely. As a result of this, the magazines will not have to be replaced with any great frequency and thereby saving considerable monetary expenditure over the course of time. It is fair to say that, hypothetically, the ASF Magazine will "last a lifetime" in normal use.

Another feature of the present disclosure is its ability to be readily adapted to a wide variety of firearm magazines of different calibers, from different manufacturers, worldwide. This same principle of a telescoping "sleeve" designed to prevent spring fatigue can be configured, adapted and applied to any high-capacity, external, box-style firearm magazine extant.

Another feature of the present disclosure is its ability to be easily disassembled/assembled for cleaning. The two "stop studs" have been designed with combination truss-head screws. The heads are flatter and more streamlined than round-head machine screws, so they will not snag on foliage or clothing. They can be removed with either a phillips or standard (slot) screwdriver from a pocket (Swiss Army-type) knife or multi-tool. In the absence of tools they can be also removed by using the case rim of an expended cartridge casing or similar improvised screwdriver. Hence, the ASF magazine can be disassembled and reassembled without tools.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is a modified ammunition magazine for firearms that incorporates an extendable lower magazine sleeve 2 in order to relieve magazine spring 4 compression when fully loaded due to long periods of storage or other inactivity, thus avoiding the undesirable condition of spring fatigue. While the present invention is originally designed with AR-style firearms in mind, it should be noted that the present invention may be adapted for any applicable type of firearm and relevant magazine type.

Figure 1:
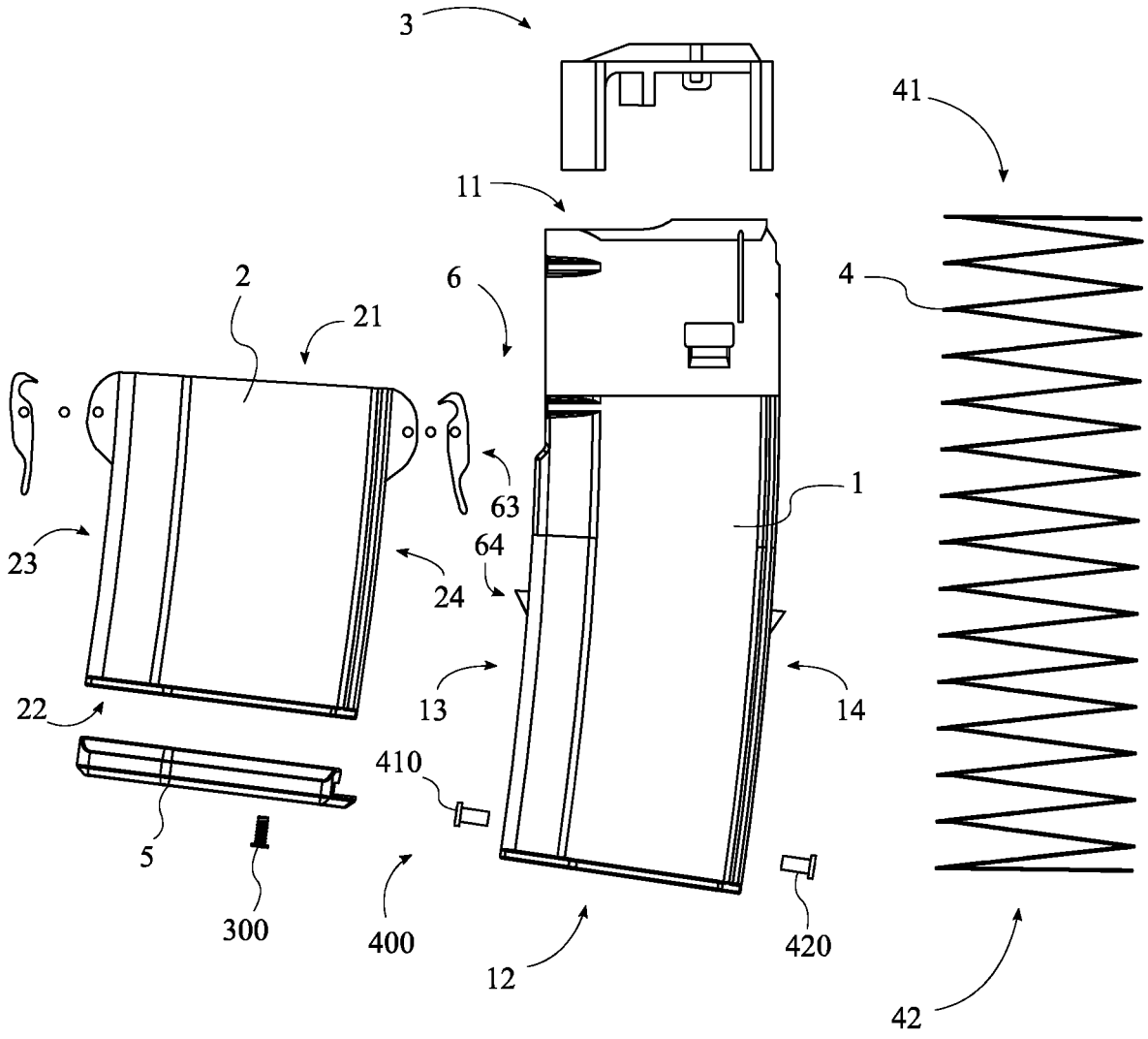
FIG. 1 is an exploded view of the present invention.
Figure 2:
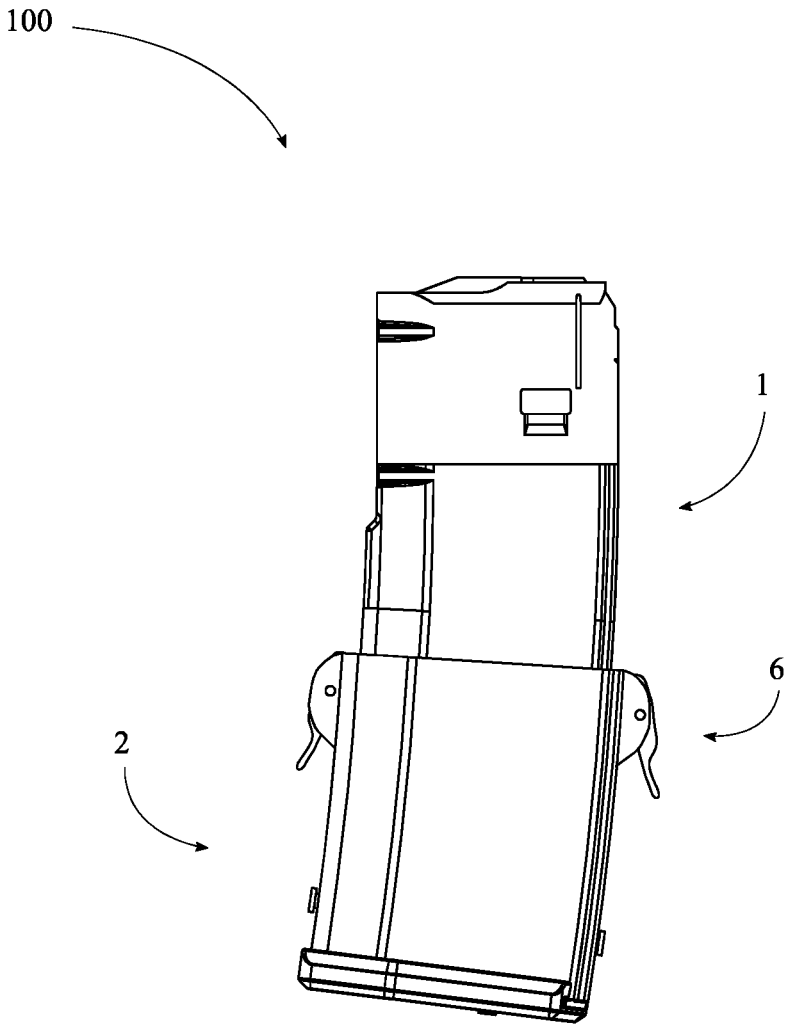
FIG. 2 shows the present invention in the compressed configuration.
Figure 3:
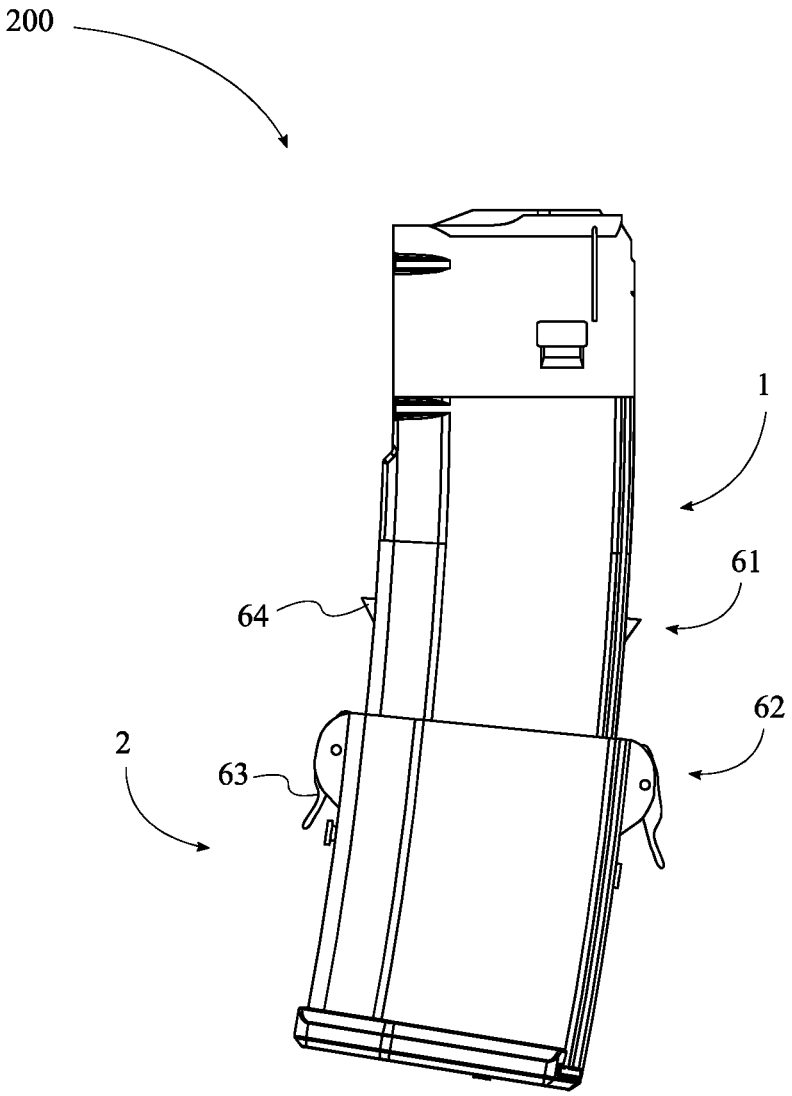
FIG. 3 shows the present invention in the expanded configuration.

Referring to FIGS. 1-3, in general, the present invention comprises a magazine body 1, a lower magazine sleeve 2, a follower 3, a magazine spring 4, a floorplate 5, and a fastening mechanism 6. The lower magazine sleeve 2 slides over the bottom end of the magazine body 1 and is selectably positionable between a compressed configuration 100 and an extended configuration 200. In the compressed configuration 100, the fully assembled present invention closely matches the shape and form of an unmodified magazine and is ready for use. In the extended configuration 200, the lower magazine sleeve 2 slides away from the magazine body 1, providing additional space in order to relax the magazine spring 4, thus avoiding spring fatigue due to long periods of compression. The purpose of the follower 3 is for aligning and urging cartridges toward the firearm in parallel offset rows, with the follower 3 adapted to receive upward pressure from below. This is accomplished by using a coil-type spring resting on the magazine floorplate 5 and biasing the follower 3 and cartridges toward the firearm.

The magazine body 1 holds and feeds cartridges into a firearm. In the preferred embodiment of the present invention, the magazine body 1 is or is closely based on a standard, 30-round AR-type magazine already in production by numerous manufacturers. For the purposes of prototype construction, the AR-type magazine was chosen because the AR-style firearms are presently the most popular type of rifle platform in the country. The magazine body 1 and subsequent parts may be manufactured from plastic, polymer, aluminum, carbon fiber, steel, or any other suitable materials.

The magazine body 1 comprises a top magazine end 11, a bottom magazine end 12, a first lateral magazine side 13 and a second lateral magazine side 14. The magazine body 1 longitudinally extends between the top magazine end 11 and the bottom magazine end 12, and the magazine body 1 laterally extends between the first lateral magazine side 13 and the second lateral magazine side 14. In the preferred embodiment of the present invention, the magazine body 1 is tapered inwardly adjacent to the bottom end to remove any possibility of the magazine spring 4 catching on the base of the magazine body 1 when the present invention is in the compressed configuration 100, ensuring smooth operation.

Similarly, the lower magazine sleeve 2 comprises a top sleeve end 21, a bottom sleeve end 22, a first lateral sleeve side 23 and a second lateral sleeve side 24. The lower magazine sleeve 2 longitudinally extends between the top sleeve end 21 and the bottom sleeve end 22, and the lower magazine sleeve 2 laterally extends between the first lateral sleeve side 23 and the second lateral sleeve side 24. The purpose of the lower magazine sleeve 2 is to provide a space in which to relax the compression on the magazine spring 4 during periods of inactivity, thereby defeating the condition of spring fatigue. The sleeve merely acts as an extension of the magazine body 1, and will not contain cartridges at any time. The lower magazine sleeve 2 is constructed to closely follow the external profile of the main body magazine. The magazine body 1 sleeves inside the lower magazine sleeve 2 with close tolerances so that the resulting union does not result in bulkiness. However, the lower magazine sleeve 2 is constructed so that the sleeve slides easily outside the magazine body 1 without binding. The sleeve does not contain any internal protrusions or obstructions of any kind, allowing the magazine spring 4 to expand and compress smoothly as the magazine body 1 and the lower magazine sleeve 2 are extended and contracted. In the preferred embodiment, the sleeve has been fitted with "pawl lever latch" housings, one in the front and one in the rear. A small, square area has been removed at the top of the sleeve, and is shrouded on either side by the latch housings. This inlet provides a space to receive and mate the "latch-ledges" to the lever latches. This allows the sleeve to be positioned all the way up to the magazine well of the firearm when the present invention is in its compressed position, to provide a low-profile when in use.

The floorplate 5 is removably positioned adjacent to the bottom magazine sleeve end. The purpose of the floorplate 5 is to enclose the follower 3 and magazine spring 4 into the cavity of the magazine body 1. The magazine spring 4 rests upon the floorplate 5. In some embodiments, the floorplate 5 is attached to the base of the lower magazine sleeve 2 by two machine screws, threaded into two inserts welded into the bottom sides of the sleeve. A tongue-and-groove attachment method has been facilitated on the back side of the sleeve. There are many simpler and more conventional methods that can be used. For example, a sliding floorplate 5 which is secured by tension between corresponding tabs and the bottom edges of the sleeve can be used, as it would be simpler and more cost effective to resort to this method. Since the lower magazine sleeve 2 wraps around the magazine body 1, a slightly larger floorplate 5 than that used by conventional magazines, regardless of the attachment method, must be utilized.

Figure 4:
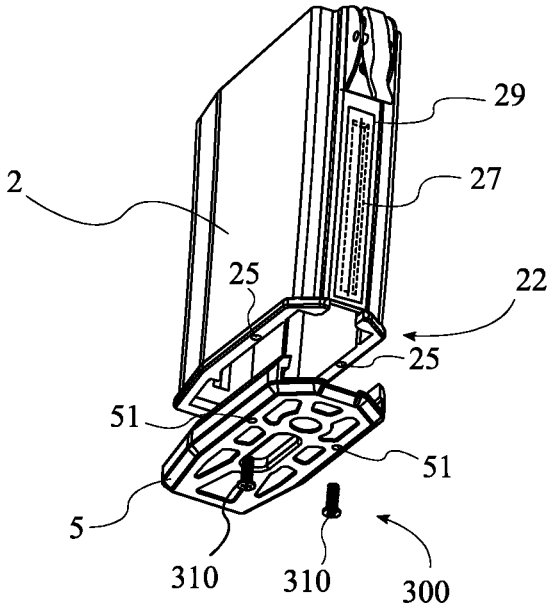
FIG. 4 is an exploded view of the lower magazine sleeve, the floorplate, and the floorplate screws.

Referring to FIG. 4, in the preferred embodiment, the floorplate 5 is removably connected to the bottom magazine sleeve end. Furthermore, the preferred embodiment of the present invention comprises at least one floorplate fastener 300, and the floorplate 5 is removably attached to the bottom sleeve end 22 through the at least one floorplate fastener 300. More particularly, the at least one floorplate fastener 300 comprises a pair of screws 310, while the floorplate 5 comprises a pair of floorplate holes 51, and the lower magazine plate comprises a pair of threaded holes 25. The pair of threaded holes 25 traverses into the bottom sleeve end 22, and the pair of screws 310 is removably engaged through the pair of floorplate holes 51 and into the pair of threaded holes 25 in order to attach the floorplate 5 to the lower magazine sleeve 2. In the preferred embodiment, the pair of screws 310 are 10-32 machine screws that are threaded into two female inserts welded into the bottom sides of the sleeve. Regardless of the method of attachment, the floorplate 5 must be sufficiently secured to be able to withstand the compressed spring tension exerted by the magazine spring 4 when the magazine is fully loaded without opening. It should be noted herein that the specific means of attachment of the floorplate 5 to the lower magazine sleeve 2 is not of particular consequence, so long as the floorplate 5 may be readily removed for maintenance in the field. The previously disclosed attachment means of the floorplate 5 to the lower magazine sleeve 2 represents a prototype embodiment and should not be considered limiting. In various embodiments, the floorplate 5 may utilize any desirable attachment means to attach to the base of the lower magazine sleeve 2. Any conventional floorplate currently in use or new floorplate design may be substituted without changing the spirit and scope of the present invention. For example, a conventional floorplate may be utilized with the present invention which employs a tab-and-slot configuration.

Figure 6:
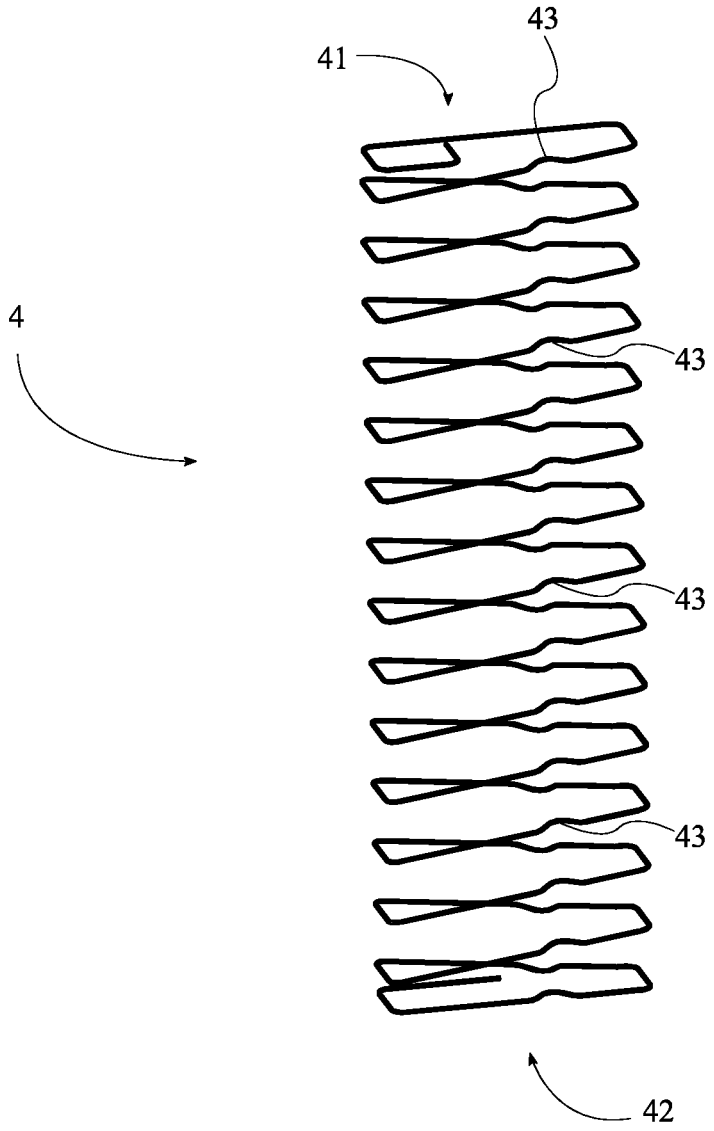
FIG. 6 depicts an exemplary embodiment of the magazine spring.

The magazine spring 4 is positioned within the magazine body 1 and the lower magazine sleeve 2 and comprises a top spring end 41 and a bottom spring end 42. The bottom spring end 42 is positioned adjacent to the floorplate 5, and the follower 3 is positioned adjacent to the top spring end 41 opposite the bottom spring end 42 along the magazine spring 4. The magazine spring 4 urges cartridges toward the firearm stacked atop the follower 3, the follower 3 being adapted to receive upward pressure from the magazine spring 4. In some embodiments, the magazine spring 4 is a coil spring wherein the coil is rectangular in form, and the spring may be made of, for example, music wire having a circular cross-section of 0.060", its outside diameter of approximately 0.700", its free length being approximately 13 feet and has 15 coils. This magazine spring 4 has been custom-designed specifically for the numerous advantages and purposes of the ASF Magazine. FIG. 6 shows such an exemplary embodiment. However, the magazine spring may vary in different embodiments. Original Equipment Manufacture (OEM) springs are designed to work within the confines of a standard magazine which has been designed with stamped ribs protruding inward. In addition to stiffening the magazine body 1, the ribs also provide a channel or guide in which the magazine spring 4 compresses and relaxes, in and up-and-down motion. Since the ASF Magazine provides a telescoping sleeve into which the spring must operate, there are no channels or supports for an OEM spring. This results in the adverse condition of the OEM spring to "snake". The unsupported coils of the OEM spring will take the path of least resistance and kink inside the sleeve, resulting in the feeding process of the magazine to jam. The custom-designed spring for the ASF Magazine has been designed to mirror the profile of the follower 3 itself, and completely fills the internal cavity of the magazine. It should be noted again and well understood that the lateral dimensions of the magazine spring 7 of the present invention needs to correspond as closely as possible to the internal lateral dimensions of the magazine body 1 and lower magazine sleeve 2 wherever possible. This completely eliminates the possibility of the spring to snake, since there is no room for the spring to kink within the confines of the magazine sleeve. Another advantage of the custom ASF Magazine spring 4 is that weight and spring tension are more evenly and completely distributed across the bottom of the magazine follower 3, discouraging the follower's 3 tendency to tilt. Moreover, the top spring end 41 of the magazine spring 41 should be configured to correspond directly with one or more under-surfaces, contours, protrusions, cavities, or other features of the follower 3 that the top spring end 41 comes into direct contact with when in use; this limitation assures that the top spring end 41 is flush or otherwise securely positioned against the bottom side of the follower 3, thereby guarding against follower tilt.

Figure 8:
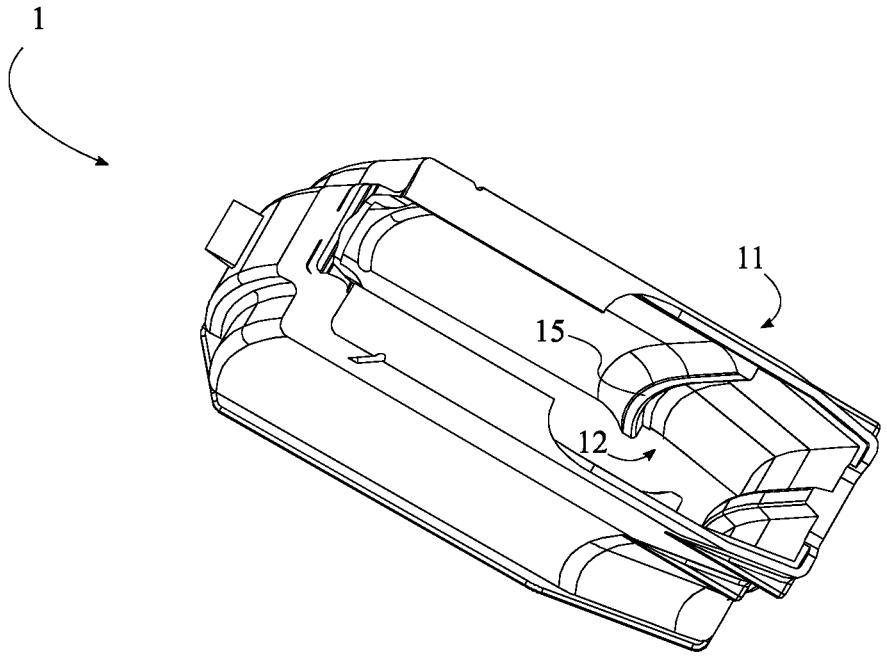
FIG. 8 is a perspective view of one embodiment of the magazine body comprising an internal rib.

Moreover, referring to FIGS. 6 and 8, in order to further ensure correct alignment of the magazine spring 4 within the magazine body 1, in some embodiments the magazine body 1 may further comprise at least one internal rib 15 which traverses between vertically along an internal lateral surface of the magazine body 1 between the top magazine end 11 and the bottom magazine end 12. The at least one internal rib 15 may be a currently existing feature in firearm magazines, which is herein adapted for the purpose of aligning of the magazine spring 4, or the internal rib 15 may be a newly designed feature specialized for the aforementioned purpose. To correspond with the internal rib 15, the magazine spring 4 further comprises a plurality of lateral indents 43. Wherein the magazine spring is composed of a plurality of coils connected to each other in a series, each of the plurality of coils comprises one of the plurality of lateral indents 43. When the present invention is assembled, the plurality of lateral indents 43 is aligned with the at least one internal rib 15; thus, lateral movement of the magazine spring 4 within the magazine body 1 is prevented by the interaction of the internal rib 15 of the magazine body 1 and the plurality of lateral indents 43 of the magazine spring, as the internal rib 15 will abut against the lateral indents 43, confining them to the path of the internal rib 15 and aligning the magazine spring 4 within the magazine body 1.

The lower magazine sleeve 2 is slidably positioned over the bottom magazine end 12 of the magazine body 1 such that the bottom magazine end 12 of the magazine body 1 traverses into the lower magazine sleeve 2. As previously disclosed, the lower magazine sleeve 2 is selectably positionable relative to the magazine body 1 between a compressed configuration 100 and an extended configuration 200; as such, the lower magazine sleeve 2 is telescopically engaged with the magazine body 1. The lower magazine sleeve 2 is removably engaged into the compressed position through the fastening mechanism 6.

It is contemplated that in various embodiments, the fastening mechanism 6 may vary in nature and design. Generally, the fastening mechanism 6 comprises a first fastening portion 61 and a second fastening portion 62, as seen in FIG. 3. The first fastening portion 61 is connected to the magazine body 1 between the top magazine end 11 and the bottom magazine end 12, and the second fastening portion 62 is connected to the lower magazine sleeve 2 adjacent to the top sleeve end 21. The first fastening portion 61 and the second fastening portion 62 are removably engaged with each other in the compressed configuration 100.

More particularly, in the preferred embodiment of the present invention, the fastening mechanism 6 comprises at least one lever latch arm 63 and at least one latch receiving portion 64, as shown in FIGS. 1 and 3. The at least one lever latch arm 63 is laterally connected to the lower magazine sleeve 2 adjacent to the top sleeve, and the at least one latch receiving portion 64 is laterally connected to the magazine body 1 between the top magazine end 11 and the bottom magazine end 12. The at least one lever latch arm 63 engages with the at least one latch receiving portion 64 in order to affix the lower magazine sleeve 2 into the compressed configuration 100. The latch receiving portions may be alternatively referred to in some instances herein as latch ledges.

Figure 5:
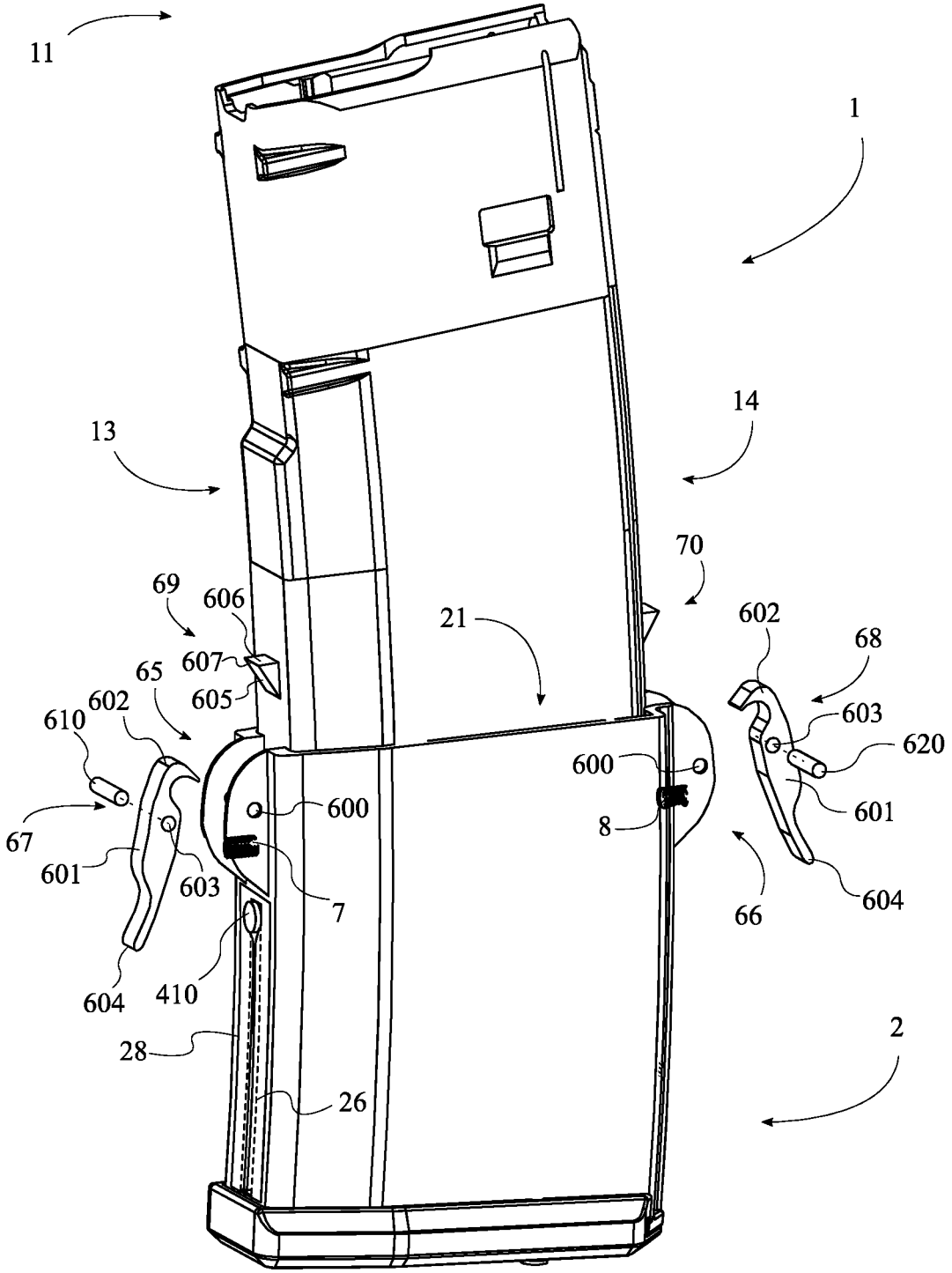
FIG. 5 shows the fastening mechanism in an exploded state, with the latch springs revealed through the latch housings.

Even more particularly, referring to FIG. 5, in the preferred embodiment, the fastening mechanism 6 comprises a first latch housing 65, a second latch housing 66, a first lever latch arm 67, a second lever latch arm 68, a first latch receiving portion 69 and a second latch receiving portion 70. The purpose of the latch housings is to hold the first lever latch arm 67 and second lever latch arm 68, which are pawl lever latches. In some embodiments, the latch housings are welded to the outside of the lower magazine sleeve 2, and contoured to provide the lowest profile possible.

The first latch housing 65 is connected to the first lateral sleeve side 23 adjacent to the top sleeve end 21, and the second latch housing 66 is connected to the second lateral sleeve side 24 adjacent to the top sleeve end 21. The first lever latch arm 67 is rotatably connected within the first latch housing 65, and the second lever latch arm 68 is rotatably connected within the second latch housing 66.

The first latch receiving portion 69 is connected to the first lateral magazine side 13 between the top magazine end 11 and the bottom magazine end 12, while the second latch receiving portion 70 is connected to the second lateral magazine side 14 between the top magazine end 11 and the bottom magazine end 12. The first latch receiving portion 69 and the second latch receiving portion 70 provide a place for the first lever latch arm 67 and the second lever latch arm 68 to securely connect and hold the lower magazine sleeve 2 in place after the magazine spring 4 is compressed and the present invention is ready for operation.

The first latch receiving portion 69 and the second latch receiving portion 70 are longitudinally positioned at the same distance between the top magazine end 11 and the bottom magazine end 12. The first latch receiving portion 69 and the second latch receiving portion 70 should be positioned approximately halfway between the top magazine end 11 and the bottom magazine end 12, though this distance may vary in different embodiments. The distance between the two latch portions and the bottom magazine end 12 of the magazine body 1 should correspond approximately with the distance between the latch housings and the bottom sleeve end 22 of the lower magazine sleeve 2. The first lever latch arm 67 and the second lever latch arm 68 are each removably engaged with the first latch receiving portion 69 and the second latch receiving portion 70, respectively, in the compressed configuration 100.

Furthermore, the preferred embodiment comprises a first latch spring 7, a second latch spring 8, a first pin 610 and a second pin 620. FIG. 5 shows the latch springs revealed through the latch housings. The first lever latch arm 67 and the second lever latch arm 68 each comprise a lever body 601, a pawl 602, a lever pin hole 603, and a release portion 604. The pawl 602 is a hook-shaped portion configured to engage with the latch receiving portions in order to obstruct motion of the lower magazine sleeve 2 away from the magazine body 1 when the lower magazine sleeve 2 is in the compressed configuration 100. The first latch housing 65 and the second latch housing 66 each comprise at least one housing pin hole 600. The pawl 602 is terminally connected to the lever body 601, and the release portion 604 is terminally connected to the lever body 601 opposite the pawl 602 along the lever body 601.

The lever pin hole 603 perpendicularly traverses through the lever body 601 between the pawl 602 and the release portion 604. The at least one housing pin hole 600 of the first latch housing 65 perpendicularly traverses through the first latch housing 65, and the at least one housing pin hole 600 of the second latch housing 66 perpendicularly traverses through the second latch housing 66.

Furthermore, the first pin 610 traverses through the at least one housing pin hole 600 of the first latch housing 65 and through the lever pin hole 603 of the first lever latch arm 67, such that the first pin 610 acts as a fulcrum for the first lever latch arm 67. Similarly, the second pin 620 traverses through the at least one housing pin hole 600 of the second latch housing 66 and through the lever pin hole 603 of the second lever latch arm 68, such that the second pin 620 acts as a fulcrum for the second lever latch arm 68. The first latch spring 7 is positioned between the first lateral magazine side 13 and the release portion 604 of the first lever latch arm 67, and the second latch spring 8 is positioned between the lateral magazine side and the release portion 604 of the second lever latch arm 68. The latch springs apply lateral outward force to the lever latch arms, forcing the pawls of the lever latch arms to rotate inward toward the magazine body 1 in order to mate with the latch receiving portions. In some embodiments, the latch springs are coil type springs, exerting approximately 8 pounds of pressure to the lower part of the lever latches. The latch springs are set into a ⅛" wide recess drilled in the base of the lever latch housings, and into a ⅛" wide hole on the inside (bottom) of the lever latches. They are secured into the lever latch housings by epoxy so they do not slip out of place as a result of the vibration incurred when the firearm is operating. This application of the springs allows the latches to efficiently function in a lever-fashion, using the latch pin as a fulcrum. Coil springs may not be ideal for the current application, however, as foreign matter intruding into the latch springs may cause poor or failed operation. As such, alternatively, in some embodiments, the first latch spring 7 and the second latch spring 8 may each be a leaf spring, or the first latch spring 7 and the second latch spring 8 may each be a torsion spring. Having the latch springs be leaf springs or torsion springs may additionally prove less expensive and less complicated in the manufacturing process.

In the preferred embodiment, the first latch receiving portion 69 and the second latch receiving portion 70 each comprise a ramp 605, a ledge 606, and a distal edge 607. The ledge 606 extends laterally outward from the magazine body 1 to the distal edge 607, and the ramp 605 is connected between the magazine body 1 and the ledge 606, tapering outward from the magazine body 1 to the distal edge 607, longitudinally upward toward the top magazine end 11.

Thus, as the lower magazine sleeve 2 moves from the extended configuration 200 to the compressed configuration 100, the pawls of the lever latch arms ride up the ramp 605 and fall into place on the ledge 606 after passing the distal edge 607, locking the lower magazine sleeve 2 into the compressed configuration 100. In order to release the lower magazine sleeve 2 from the compressed configuration 100, the user must press on the release portions 604, applying a moment force to the lever latch arms about the pins in order to rotate the pawls 602 of the lever latch arms past the distal edge 607 of the latch receiving portions and thus allowing the lower magazine sleeve 2 to slide from the compressed configuration 100 to the extended configuration 200.

The two lever latch arms, or lever-latches, hold the lower magazine sleeve 2 to the magazine body 1 in the compressed configuration 100 position, and provide a quick release thereof when the need to employ it arises. Although other methods of attachment could be used, these lever-latches were chosen so the operator can compress the magazine spring 4 instantly, and the latches hold it securely in its fully compressed condition while the magazine is in operation. This is accomplished by installing the latch springs beneath the lever latch arms so that the latch arms can captivate the latch ledge 606*s* and hold the magazine sleeve firmly in place. Between the inward pressure of the latch coil springs exerting pressure on the mated latches and ledges, and the downward pressure of the compressed magazine spring 4, the lever latches will hold the magazine sleeve (f) securely in its closed position while the magazine is in operation. These lever latches were hand-made of steel for the prototype, as no commercially-made pawl lever latches could be acquired during the time of construction. These latches are designed to interlock with the latch ledge securely. Both the latch and latch ledge are each interlocking at approximately a 45° angle providing high-torque leverage. This method of connection is often referred to as a "French Cleat", and is used extensively in metal, plastic and wood mounting systems.

Figure 7:
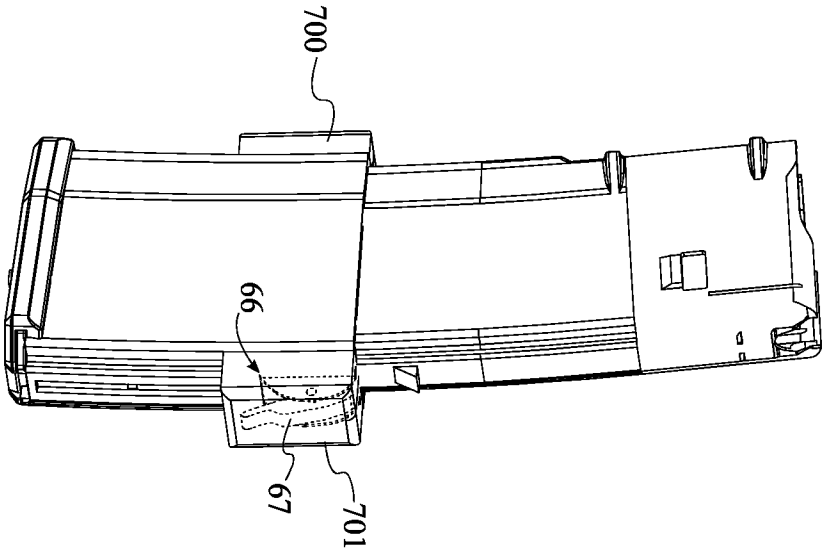
FIG. 7 shows an alternative embodiment comprising flexible protective covers around the latch housings.

It is contemplated that the present invention would benefit from features that would prevent environmental hazards such as dirt, sand, dust, and other foreign matter from entering the present invention and interfering with its operation. Such hazards may be prevalent in many combat locations or other relevant situations where the present invention may be employed. As such, referring to FIG. 7, alternatively or additionally, some embodiments of the present invention further comprise a first protective cover 700 and a second protective cover 701. The first protective cover 700 is positioned around the first latch housing 65 and the second protective cover 701 is positioned around the second latch housing 66. The main purpose of the first protective cover 700 and the second protective cover 701 is to act as a protective "bubble" to prevent dirt, sand, dust, and other debris from encroaching into the fastening mechanism 6 in order to keep the fastening mechanism 6 in good working order in less than hospitable environments where the present invention may be put into use. The specific nature of the first protective cover 700 and the second protective cover 701 may vary, but preferably, the first protective cover 700 and the second protective cover 701 are flexible and transparent, and extend to cover the extents of the first latch housing 65 and the second latch housing 66 respectively, in addition to the at least one lever latch arm 63 and all other components of the fastening mechanism 6. The flexible nature of the first protective cover 700 and the second protective cover 701 serves to allow the user to press on the lever latch arms to release the lower magazine sleeve 2 from the magazine body 1 even while the lever latch arms are enclosed by the protective covers. In various embodiments, the first protective cover 700 and the second protective cover 701 may be constructed from various flexible materials, such as, but not limited to, neoprene, or other flexible, transparent or translucent plastic materials. The geometry of the first protective cover 700 and the second protective cover 701 may vary in order to enclose the latch housings, but may be understood in some embodiments to be generally rectangular in shape, though any suitable shape may be comprised.

The preferred embodiment of the present invention further comprises a means to prevent the lower magazine sleeve 2 from being completely separated from the magazine body 1 without intention from the user. To this end, in general, the present invention may further comprise at least one stopping protrusion 400, or stop stud, as seen in FIG. 1. In some embodiments, one or more of the at least one stopping protrusion 400 may be laterally and externally connected to the magazine body 1 adjacent to the bottom magazine end 12. In some embodiments, various elements of the shape of the lower magazine sleeve 2 may abut against the at least one stopping protrusion 400, preventing the lower magazine sleeve 2 from being removed completely from the magazine body 1.

More particularly, in the preferred embodiment, the present invention further comprises a first stop stud 410 and a second stop stud 420, while the lower magazine sleeve 2 further comprises a first slot 26 and a second slot 27 to accommodate the two stop studs. The stop studs ride inside the two slots as the present invention is closed and opened. The purpose of the stop studs is to prevent the separation of the magazine body 1 and the lower magazine sleeve 2 into two sections when the lever latches are actuated and the magazine spring 4 tension causes the sleeve to slide down to its lower (or "open") position. These stop studs were designed and incorporated to prevent the unintentional disassembly of the present invention.

In some embodiments, these stop studs are attached by means of threaded nuts, or stop stud nuts, welded in the base of the magazine body 1 and ride inside these two slots as the present invention is closed and opened. As the name implies, the stop studs will not permit the sleeve to extend beyond the union with the main body magazine, unless they are intentionally removed by the user. In some embodiments, the stop studs are made of 10-32 "truss-head" combination machine screws, which permit the user to disassemble the ASF Magazine for routine maintenance without the use of tools. Another design option is to install a third latch ledge 606 at the bottom-rear of the main body magazine. Unless the sleeve is further modified, this third latch will only fit in the rear of the main magazine because of the ridge created by the sleeve, mimicking the outer contour of the main magazine. The stop studs would not be necessary to the ASF Magazine if another latch ledge (or similar "stop") is employed. Omitting the stop studs, stop stud nuts and the milled slots will further serve to provide a more sealed unit, aiding in the effort to keep out dust, sand, dirt and debris which may impede the magazine's performance. Furthermore, the ASF Magazine will be much easier and even more inexpensive to manufacture.

The stop stud nuts provide a solid position to which the stop studs are attached to the main body magazine. In some embodiments, these are two square steel 10-32 threaded nuts, welded into the main body magazine at its base. They are also tapered and "rounded over" internally so that the magazine spring 4 will not catch on them; but instead will easily slide over them. When the main body magazine and sleeve are assembled together, the stop studs are inserted through the milled slots into the stop stud nuts and tightened down securely. The main magazine and the sleeve now cannot be separated unless it is the intention of the user to separate them The first slot 26 traverses through the first lateral sleeve side 23 between the first latch housing 65 and the bottom sleeve end 22, and the second slot 27 traverses through the second lateral sleeve side 24 between the second latch housing 66 and the bottom sleeve end 22. The first stop stud 410 traverses through the first slot 26 and is externally and removably attached to the first lateral magazine side 13. Preferably, the first lateral magazine size comprises a first threaded hole into which the first stop stud 410 may be removably engaged. Similarly, the second stop stud 420 traverses through the second slot 27 and is externally and removably attached to the second lateral magazine side 14, and the second lateral magazine size comprises a second threaded hole into which the first stop stud 410 may be removably engaged. In some embodiments, two stop stud nuts have are welded to the inside of the magazine body 1 adjacent to the bottom magazine end 12. These provide the threaded holes into which the stop studs may be engaged in order to prevent the ASF Magazine to be separated into two sections, unless it is the intention of the possessor to do so.

In some embodiments, the present invention further comprises a first dust gasket 28 and a second dust gasket 29, as seen in FIGS. 4-5. The first dust gasket 28 and the second dust gasket 29 are configured to prevent dirt, dust, and any other debris from entering the present invention while in use, particularly through the first slot 26 and the second slot 27 of the lower magazine sleeve 2. The first dust gasket 28 is connected to the lower magazine sleeve 2 around the first slot 26, while the second dust gasket 29 is connected to the lower magazine sleeve 2 around the second slot 27. The first and second dust gaskets may be either externally or internally connected to the lower magazine sleeve 2 around the slots, or they may be perimetrically connected within the slots, whichever is suitable and desired in various embodiments. The dust gaskets in the preferred embodiment are generally flat, flexible bodies, each comprising a slit oriented parallel to the respective slots of the lower magazine sleeve 2. The first stop stud 410 is positioned within the slit of the first dust gasket 28, while the second stop stud 420 is positioned within the slit of the second dust gasket 29. The dust gaskets function to generally occlude the slots against penetration by dirt, dust, and other foreign material while still allowing the stop studs to ride within the slots in order to retract or extend the lower magazine sleeve. In various embodiments, the first dust gasket 28 and the second dust gasket 29 may be made of various different materials, such as, but not limited to, neoprene rubber, or any other suitable, flexible material or inflexible material if an implementation of such material according to the spirit and purpose of the dust gaskets as disclosed herein is suitable.

Once the stop studs are removed, the magazine body 1 and the lower magazine sleeve 2 are allowed to separate, and the magazine spring 4 and follower 3 may slide out, as with a conventional magazine. Then, the floorplate 5 can be removed by removing the floorplate fasteners 300. The ASF Magazine is now "field-stripped" and disassembled for cleaning. If a more detailed disassembly is desired, a ⅛" drift punch may be used to drive out the two latch pins and remove the lever latches. The two lever latch springs are epoxied in place and should not be removed.

In the extended configuration 200, the magazine spring 4 is extended. If the magazine body 1 is fully loaded with cartridges, the spring is not fully compressed. The magazine sleeve encloses the uncompressed magazine spring 4, which rests upon the floorplate 5 below, and across the bottom of the follower 3 above, inside the main magazine body 1. Although the magazine is fully loaded with 30 cartridges, they do not enter into the lower magazine sleeve 2. The stop studs are located at the top of the slots, and prevent the sleeve from separating from the main magazine body 1. In this condition, the problem of spring fatigue cannot occur, as the circumstances and conditions which cause spring fatigue are absent. The ASF Magazine can be stored fully loaded in this state without the risk of spring fatigue occurring and rendering the magazine useless.

In the compressed configuration 100, the magazine spring 4 is fully compressed if the magazine body 1 is fully loaded with cartridges. The lower magazine sleeve 2 encloses the main magazine body 1, which houses the cartridges and compressed magazine spring 4, which rests upon the floorplate 5 below, and across the bottom of the follower 3 above, inside the main magazine body 1. The stop studs are located at the bottom of the slots in the sleeve. The two lever latches are engaging the two latch ledges and are mechanically interlocked, holding the magazine sleeve in its compressed configuration 100. Together, they prevent the sleeve from sliding down the outside of the main magazine body 1 under pressure of the magazine spring 4. The floorplate 5 is contacting the bottom of the main magazine body 1 inside the sleeve, and is holding the magazine spring 4 to its maximum compression. Mechanically and operationally, there is absolutely no difference between a typical magazine and the ASF Magazine at this time.

The ASF Magazine may be stored fully loaded, with the magazine sleeve in the extended configuration 200. In this condition, the magazine spring 4 does not suffer from the detrimental condition of spring fatigue during periods of storage/inactivity. When the need arises, the ASF Magazine spring 4 can be compressed in less than one second and put into action, with performance virtually identical to, and indistinguishable from standard, conventional magazines of the same type. The ASF Magazine is only minimally longer and wider than a standard magazine in its compressed configuration 100.

As a final matter, pursuant to the aforementioned goal of being resistant against sand, dirt, and other foreign matter, it may be noted that one region of concern may be the interface point between the top sleeve end 21 of the lower magazine sleeve 2 and the magazine body 1. Since the top sleeve end 21 must traverse along the sides of the magazine body 1 in order to move between the compressed configuration 100 and the extended configuration 200, a certain tolerance must be achieved between the top sleeve end 21 and the sides of the magazine body 1 to allow this movement to occur without excessive friction. However, this tolerance may potentially allow sand or other foreign matter to enter the present invention and interfere with its operation. Some current similar firearm magazines employ one or more grooves stamped into the sides of the magazine. These grooves provide stiffness to the magazine, and may also act as an internal guide for the magazine spring. However, in the current invention, said grooves would provide additional external areas for sand or other debris to enter the lower magazine sleeve 2 and/or the magazine body 1. Thus, it should be noted that it is preferable to omit any depressions in the external surface of the magazine body 1 of the present invention if such grooves are comprised, and the external surface should have as smooth a finish as possible in order to ensure as tight a tolerance as possible between the top sleeve end 21 and the lateral sides of the magazine body 1 in order to prevent sand or other debris from entering the lower magazine sleeve 2 and/or the magazine body 1 through this interface. To clarify, such grooves may still be utilized in the present invention to provide stiffness and act as an internal guide for the magazine spring 4, but their presence should be limited to protruding internally into the magazine body 1, and not present themselves as depressions in the external surface of the magazine body 1. If a currently available magazine with such grooves is used to create the present invention, the grooves should be filled in externally in order to ensure a smooth surface finish and prevent encroachment of sand and other debris into the internal space of the present invention. Moreover, in some embodiments, alternatively or additionally, one or more seals may be employed between the top sleeve end 21 and the magazine body 1. To this end, in some embodiments, the lower magazine sleeve 2 may comprise at least one seal that is connected to the top sleeve end 21 of the lower magazine sleeve 2, wherein the at least one seal is configured to seal the top sleeve end against the magazine body 1 against encroachment from foreign matter. In some embodiments, the at least one seal may take the form of a neoprene "lip," a "tadpole gasket," or any other suitable configuration which enables the previously disclosed purpose.

Although the invention has been explained in relation to its preferred embodiment, it is to be understood that many other possible modifications and variations can be made without departing from the spirit and scope of the invention as hereinafter claimed.

What is claimed is:

1. An anti-spring fatigue firearm magazine comprises:

a magazine body;

a lower magazine sleeve;

a follower;

a magazine spring;

a floorplate;

a fastening mechanism;

the magazine body comprises a top magazine end, a bottom magazine end, a first lateral magazine side and a second lateral magazine side;

the lower magazine sleeve comprises a top sleeve end, a bottom sleeve end, a first lateral sleeve side and a second lateral sleeve side;

the magazine body longitudinally extending between the top magazine end and the bottom magazine end;

the magazine body laterally extending between the first lateral magazine side and the second lateral magazine side;

the lower magazine sleeve longitudinally extending between the top sleeve end and the bottom sleeve end;

the lower magazine sleeve laterally extending between the first lateral sleeve side and the second lateral sleeve side;

the magazine spring comprises a top spring end and a bottom spring end;

the floorplate being removably positioned adjacent to the bottom magazine sleeve end;

the lower magazine sleeve being slidably positioned over the bottom magazine end of the magazine body, wherein the bottom magazine end of the magazine body traverses into the lower magazine sleeve, and wherein the lower magazine sleeve is selectably positionable relative to the magazine body between a compressed configuration and an extended configuration;

the magazine spring being positioned within the magazine body and the lower magazine sleeve;

the bottom spring end being positioned adjacent to the floorplate;

the follower being positioned adjacent to the top spring end opposite the bottom spring end along the magazine spring;

the lower magazine sleeve being removably engaged into the compressed position through the fastening mechanism;

the magazine body comprises an internal rib;

the internal rib internally traversing along the magazine body between the top magazine end and the bottom magazine end;

the magazine spring further comprises a plurality of lateral indents; and the plurality of lateral indents of the magazine spring being aligned with the internal rib of the magazine body, wherein the internal rib is configured to align the magazine spring within the magazine body.

2. The anti-spring fatigue firearm magazine as claimed in claim 1 comprises:

the lower magazine sleeve being telescopically engaged with the magazine body.

3. The anti-spring fatigue firearm magazine as claimed in claim 1 comprises:

the fastening mechanism comprises a first fastening portion and a second fastening portion;

the first fastening portion being connected to the magazine body between the top magazine end and the bottom magazine end;

the second fastening portion being connected to the lower magazine sleeve adjacent to the top sleeve end; and the first fastening portion and the second fastening portion being removably engaged with each other in the compressed configuration.

4. The anti-spring fatigue firearm magazine as claimed in claim 1 comprises:

the fastening mechanism comprises at least one lever latch arm and at least one latch receiving portion;

the at least one lever latch arm being laterally connected to the lower magazine sleeve adjacent to the top sleeve end; and the at least one latch receiving portion being laterally connected to the magazine body between the top magazine end and the bottom magazine end.

5. The anti-spring fatigue firearm magazine as claimed in claim 1 comprises:

the fastening mechanism comprises a first latch housing, a second latch housing, a first lever latch arm, a second lever latch arm, a first latch receiving portion and a second latch receiving portion;

the first latch housing being connected to the first lateral sleeve side adjacent to the top sleeve end;

the second latch housing being connected to the second lateral sleeve side adjacent to the top sleeve end;

the first lever latch arm being rotatably connected within the first latch housing;

the second lever latch arm being rotatably connected within the second latch housing;

the first latch receiving portion being connected to the first lateral magazine side between the top magazine end and the bottom magazine end;

the second latch receiving portion being connected to the second lateral magazine side between the top magazine end and the bottom magazine end; and the first lever latch arm and the second lever latch arm being removably engaged with the first latch receiving portion and the second latch receiving portion, respectively, in the compressed configuration.

6. The anti-spring fatigue firearm magazine as claimed in claim 5 comprises:

a first latch spring and a second latch spring;

a first pin and a second pin;

the first lever latch arm and the second lever latch arm each comprise a lever body, a pawl, a lever pin hole, and a release portion;

the first latch housing and the second latch housing each comprise at least one housing pin hole;

the pawl being terminally connected to the lever body;

the release portion being terminally connected to the lever body opposite the pawl along the lever body;

the lever pin hole perpendicularly traversing through the lever body between the pawl and the release portion;

the at least one housing pin hole of the first latch housing perpendicularly traversing through the first latch housing;

the at least one housing pin hole of the second latch housing perpendicularly traversing through the second latch housing;

the first pin traversing through the at least one housing pin hole of the first latch housing and the lever pin hole of the first lever latch arm, wherein the first pin acts as a fulcrum for the first lever latch arm;

the second pin traversing through the at least one housing pin hole of the second latch housing and the lever pin hole of the second lever latch arm, wherein the second pin acts as a fulcrum for the second lever latch arm;

the first latch spring being positioned between the first lateral magazine side and the release portion of the first lever latch arm; and the second latch spring being positioned between the second lateral magazine side and the release portion of the second lever latch arm.

7. The anti-spring fatigue firearm magazine as claimed in claim 6 comprises:

the first latch spring and the second latch spring each being a leaf spring.

8. The anti-spring fatigue firearm magazine as claimed in claim 6 comprises:

the first latch spring and the second latch spring each being a torsion spring.

9. The anti-spring fatigue firearm magazine as claimed in claim 5 comprises:

the first latch receiving portion and the second latch receiving portion each comprise a ramp, a ledge, and a distal edge;

the ledge being extending laterally from the magazine body to the distal edge; and the ramp being connected between the magazine body and the ledge, wherein the ramp is tapered outward from the magazine body to the distal edge.

10. The anti-spring fatigue firearm magazine as claimed in claim 5 comprises:

a first protective cover and a second protective cover;

the first protective cover being positioned around the first latch housing; and the second protective cover being positioned around the second latch housing.

11. The anti-spring fatigue firearm magazine as claimed in claim 1 comprises:

the magazine body being tapered inwardly adjacent to the bottom end.

12. The anti-spring fatigue firearm magazine as claimed in claim 1 comprises:

the floorplate being removably connected to the bottom magazine sleeve end.

13. The anti-spring fatigue firearm magazine as claimed in claim 1 comprises:

at least one floorplate fastener; and the floorplate being removably attached to the bottom sleeve end through the at least one floorplate fastener.

14. The anti-spring fatigue firearm magazine as claimed in claim 1 comprises:

the at least one floorplate fastener comprises a pair of screws;

the floorplate comprises a pair of floorplate holes;

the lower magazine sleeve comprises a pair of threaded holes;

the pair of threaded holes traversing into the bottom sleeve end; and the pair of screws being removably engaged through the first pair of threaded holes and the pair of threaded holes in order to attach the floorplate to the lower magazine sleeve.

15. The anti-spring fatigue firearm magazine as claimed in claim 1 comprises:

at least one stopping protrusion; and the at least one stopping protrusion being laterally and externally connected to the magazine body adjacent to the bottom magazine end.

16. The anti-spring fatigue firearm magazine as claimed in claim 1 comprises:

a first stop stud and a second stop stud;

the lower magazine sleeve comprises a first slot and a second slot;

the first slot traversing through the first lateral sleeve side between a first latch housing and the bottom sleeve end;

the second slot traversing through the second lateral sleeve side between a second latch housing and the bottom sleeve end;

the first stop stud being externally and removably attached to the first lateral magazine side;

the first stop stud traversing through the first slot;

the second stop stud being externally and removably attached to the second lateral magazine side; and the second stop stud traversing through the second slot.

17. The anti-spring fatigue firearm magazine as claimed in claim 16 comprises:

a first dust gasket and a second dust gasket, each of the first dust gasket and the second dust gasket comprising a slit;

the first dust gasket being connected around the first slot;

the second dust gasket being connected around the second slot;

the first stop stud being positioned within the slit of the first dust gasket; and the second stop stud being positioned within the slot of the second dust gasket.

18. The anti-spring fatigue firearm magazine as claimed in claim 1 comprises:

the lower magazine sleeve further comprises at least one seal; and the at least one seal being connected to the top sleeve end of the lower magazine sleeve, wherein the at least one seal is configured to seal the top sleeve end against the magazine body against encroachment from foreign matter.

* * * * *